United States Patent [19]

Brooks

[11] Patent Number: 4,777,746

[45] Date of Patent: Oct. 18, 1988

[54] PREPACKAGED PICTURE MOUNT AND MAT FOR STANDARD SIZED PHOTOGRAPHIC PICTURES

[75] Inventor: Gail Brooks, Steamboat Springs, Colo.

[73] Assignees: Leon Brooks, II, Steamboat Springs; Sidney B. Brooks, Denver, both of Colo. ; part interest to each

[21] Appl. No.: 127,517

[22] Filed: Dec. 1, 1987

Related U.S. Application Data

[63] Continuation of Ser. No. 403,863, Jul. 30, 1982, abandoned.

[51] Int. Cl.[4] ..... G09F 1/12

[52] U.S. Cl. ..... 40/152.1; 40/124.1; 40/158.1

[58] Field of Search ..... 40/158, 152.1, 124.1

[56] References Cited

U.S. PATENT DOCUMENTS

| | | | |
|---|---|---|---|
| 687,411 | 11/1901 | Stuparich | 40/158 R |
| 2,587,109 | 2/1952 | Carroll | 40/159 |
| 2,896,351 | 7/1959 | Johnson | 40/158 B |
| 2,942,368 | 6/1960 | Gale | 40/158 R |
| 2,984,922 | 5/1960 | Ladenburger et al. | 40/159 |
| 3,114,208 | 12/1963 | Wellman | 40/158 R |
| 3,304,641 | 2/1967 | Goncz | 40/158 R |
| 3,341,961 | 9/1967 | Shanks | 40/158 R |
| 3,442,041 | 5/1969 | Morgan | 40/158 R |
| 3,591,943 | 7/1971 | Green | 40/158 R |
| 3,687,770 | 8/1972 | Chase | 40/158 R |
| 3,814,518 | 6/1974 | Wichers | 355/75 |
| 3,837,987 | 9/1974 | Williams | 40/152.1 |
| 3,893,252 | 7/1975 | Chase | 40/158 |
| 3,918,188 | 11/1975 | Drower et al. | 40/158 R |
| 3,921,319 | 11/1975 | Styers et al. | 40/10 |
| 4,132,480 | 1/1979 | Reed | 355/75 |
| 4,231,833 | 11/1980 | Liberman | 40/158 |
| 4,249,328 | 2/1981 | Plumadore | 40/158 |
| 4,378,647 | 4/1983 | Stancato | 40/158 |

*Primary Examiner*—Gene Mancene
*Assistant Examiner*—Wenceslao J. Contreras
*Attorney, Agent, or Firm*—Gregg I. Anderson

[57] ABSTRACT

A laminated mount for standard sized photographs including a backboard covered on one surface thereof with a mounting adhesive, to which mounting adhesive are secured two concentrically aligned release sheets, and a separate photographic mat. The backboard is of rectangular configuration sufficiently larger than the rectangular configuration of the standard sized photograph to provide a border around the standard sized photograph. The two release sheets are separated by a score line. The first release sheet is of substantially identical dimension to the standard sized photograph to be mounted. The second release sheet is of substantially identical dimension to the mat to be mounted to the backboard. Removal of the center section release sheet allows for adhesive contact with and virtually automatic alignment with the standard sized photograph. Removal of the second release sheet framing the first release sheet provides an adhesive area to which the mat can be applied. The mat includes an opening of substantially identical dimension to the standard sized photograph. The mount and mat are prepackaged in polyethylene plastic film.

2 Claims, 1 Drawing Sheet

PREPACKAGED PICTURE MOUNT AND MAT FOR STANDARD SIZED PHOTOGRAPHIC PICTURES

This is a continuation of Ser. No. 06/403,863 filed July 30, 1982 and is now abandoned.

BACKGROUND OF THE INVENTION

1. Field of the Invention

The invention relates generally to picture framing art and more particularly to mounts onto which pictures can be secured and around which picture a mat is further secured in a permanent fixed relationship.

2. Description of the Prior Art

The mounting of a picture to a backboard or mounting board through the use of an adhesive layer covering a surface of the backboard, which adhesive layer is selectively exposed by removal of release sheets, is shown in the prior art. U.S. Pat. No. 3,687,770 to M. Chase shows how a picture can be mounted to backboard covered by a layer of pressure sensitive adhesive to which layer a cover release sheet is secured. Both the backboard and the cover release sheet have formed thereon a grid coordinant system which assists in the central positioning of the picture or article to be mounted. A similar identifying grid system is provided for on a sheet of picture mat material so that a picture viewing opening in the mat material can be cut to view the picture which was previously centered on the backboard after removal of the cover release sheet.

The '770 patent to Chase, as well as all other prior art patents, are centered around the idea of orienting, centering and aligning a picture and a mat of arbitrary size. Hence, involved coordinant grid systems and identifying means are incorporated to achieve the desired results. It has not heretofore been recognized that precut standard dimensioned mounting boards, cover release sheets and mats can be incorporated to greatly simplify the use of such a mount.

A second patent to M. Chase, U.S. Pat. No. 3,893,252, shows a slightly different apparatus for aligning the photograph to be mounted to a backboard. This patent shows a plurality of release sheet sections that can be selectively removed. The release sheets are mounted across the backboard in laterally extending strips.

The patent to P. Stuparich, U.S. Pat. No. 687,411, shows a wood veneer over a pasteboard backboard adapted for use as a photographic mount. A central area of the wood veneer can be raised or lowered relative to an outer area or boundary and does define generally a rectangular concentric arrangement. Another patent showing selectively removable adhesive material is R. Reed in U.S. Pat. No. 4,132,480. This prior art reference relates to a device for masking a film image. The cropping opening is determined by selecting one of a plurality of possible rectangular concentric openings defined by score lines in the cover sheets.

Neither Stuparich nor Reed, or any other prior art reference, show rectangular concentric release sheets adapted to center, align and ultimately mount pictures to a backboard. Stuparich is essentially a frame which allows for offsetting the picture, either above or below the surface of the outer boundary. Reed, on the other hand, is directed toward a photographic masking apparatus that requires a plurality of rectangularly concentric, easily removable, sections. Neither Stuparich nor Reed show or suggest mounting a standard sized photograph to a central section of a selectively exposed adhesive layer by removal of a release sheet. Nor is it shown to subsequently remove an outer boundary or framing release sheet to mount a mat to the additional adhesive area so exposed. The '770 patent to Chase does show a removable center section, which center section is of much smaller size than the picture to be mounted, and is only used for the limited purpose of temporarily fixing the position of the picture.

Other prior art patents do not make up for the shortcomings of the patents already discussed. The patent to L. Ladenburger, U.S. Pat. No. 2,984,922, does show a picture mount wherein adhesive is utilized to mount a frame to a backing panel. B. Morgan, U.S. Pat. No. 3,442,041, relates to a photographic mount wherein two liners or release sheets are removable from a photographic mount for purposes of adhering a photograph thereto. There is no concentric arrangement of the release sheets to provide for centering of the photograph, rather the photograph is centered against a fold line of a top flap that folds over the top of the photograph. The patent to Morgan does not show application of a mat to the adhesive surface to cover the edge of the photograph, rather the photograph is fixed on one surface and then covered by the second surface for protection.

Photographic slide mountings utilizing adhesive are seen in U.S. Pat. No. 3,591,943 to B. Green, U.S. Pat. No. 3,814,518 to R. Wichers, and U.S. Pat. No. 4,249,328 to J. Plumadore. Neither a concentric configuration for selective removal of release sheets nor the use of a mounting board in conjunction with an adhesive surface to which a standard sized photograph or picture is mounted are shown in any of these references. Another use of selective removal of adhesively secured release sheets is seen in J. Styers, U.S. Pat. No. 3,921,319, wherein an adhesive-backed label having a centrally located window is capable of defining a pocket upon selective removal of a protective covering. Another frame-like photographic mounting invention is seen in M. Williams, U.S. Pat. No. 3,837,987. Another film holder is seen in W. Carroll, U.S. Pat. No. 2,587,109.

OBJECTS AND SUMMARY OF THE INVENTION

It is the principal object of the present invention to provide a prepackaged picture mount that is quickly and easily utilized to mount standard sized photographs.

It is a further related object of the present invention to provide a photographic mount utilizing contact adhesive to secure both the standard sized photograph and a mat cooperative with the standard sized photograph.

It is a still further related object of the picture mount of the present invention to provide a precut release sheet layer having a central section release sheet of substantially the same dimension as a standard photograph size and a framing release sheet of substantially the same dimension as the mat.

In accordance with the objects of the present invention, a laminated mount for mounting photographs thereon includes a backboard covered on one surface with a mounting adhesive to which mounting adhesive two separate and distinct release sheets are secured for later removal and mounting of the photograph, a mat and an easel back, all of which are prepackaged. The backboard and release sheets are precut to dimensions based on mounting standard sized photographs to the backboard. The release sheets are rectangular, a center section release sheet being substantially equal to the standard sized photograph to be mounted and the framing release sheet extending from the central section release sheet to the exterior edge of the backboard, in concentric relationship with the rectangular center section and of substantially the same dimensions as the mat.

The photographic mat is dimensioned so as to register around the outer periphery of the backboard. The photographic mat includes a central opening therein that in turn registers with the central section release sheet and the standard photograph to be mounted within the area defined by the central section release sheet.

In use, the photograph is initially mounted by peeling off the center section release sheet from the mounting adhesive and then mounting the standard sized photograph within the guide lines provided on the backboard. The framing release sheet is then removed and the mat placed into a registered position relative to the backboard and pressed into contact with the mounting adhesive. The easel back is secured to the backboard, supporting the mounted photograph in a desired display position.

DESCRIPTION OF THE PREFERRED EMBODIMENT

Figure 2:
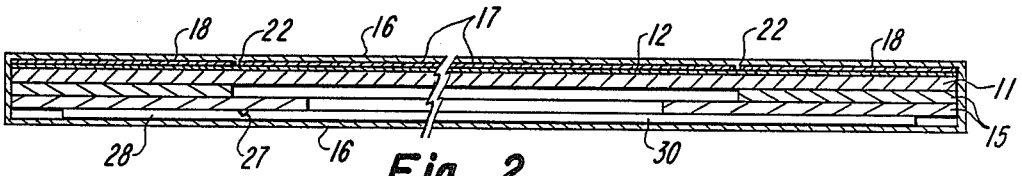
FIG. 2 is a sectional view taken along lines 2—2 of FIG. 1.

A mount 10 for photographic mounting and matting of standard sized photographs 14 is seen in the drawings. The mount 10 is of a laminated configuration including a mounting board or backboard 11 (FIG. 2), a mounting adhesive 12 and a pair of rectangularly concentrical release sheets 17 and 18 secured to the mounting adhesive 12 until such time as the standard sized photograph 14 is to be mounted. A precut double mat 15 is provided to set off and frame the photograph 14. The mount 10, mat 15 and an easel back 30 are prepackaged in a polyethylene plastic film 16 for sale as a complete unit to mount and mat photographs.

Figure 4:
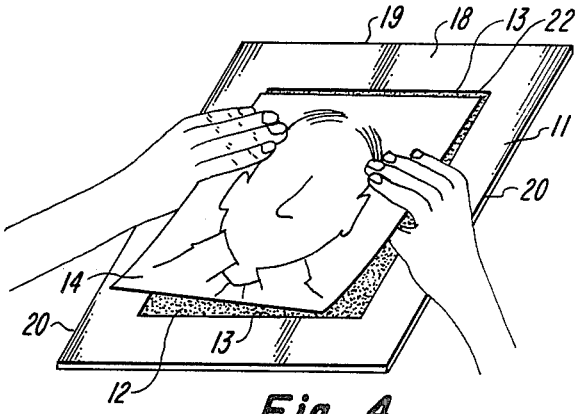
FIG. 4 is a perspective view of the second step of mounting a picture using the invention shown in FIG. 1.
Figure 5:
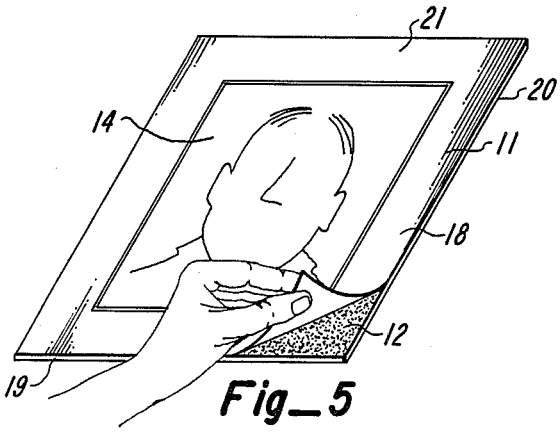
FIG. 5 is a perspective view of the third step of mounting a picture using the invention shown in FIG. 1.
Figure 6:
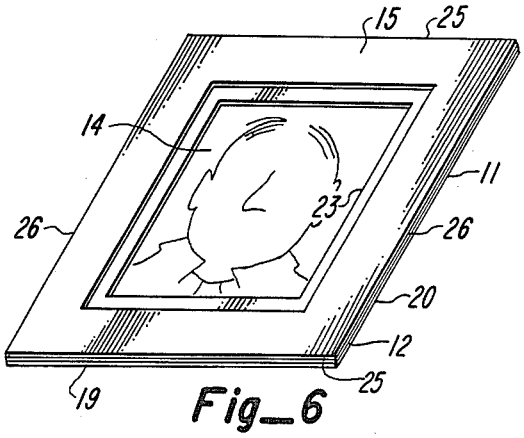
FIG. 6 is a perspective view of the fourth step of mounting a picture using the invention shown in FIG. 1.

The backboard 11 is formed of relative rigid cardboard cut into a rectangular configuration defined around the periphery thereof by top and bottom edges 19 and side edges 20. The backboard 11 is of precut dimensions that have been found to provide an aesthetically pleasing border 21 (FIG. 5) surrounding the standard sized photograph 14, once a back surface of the photograph 14 has been centrally mounted to the backboard 11 (FIGS. 4 through 6). Such a border 21 is on the order of two inches to two and one half inches for an eight and one half inch by ten inch photograph. Guide lines 13 are printed or marked onto the backboard 11 corresponding to a central position of a mounted standard sized photograph 14. The guide lines 13 extend around the periphery of the release sheet 17 and define an area slightly larger than that of the standard sized photograph 14 to be mounted. Placement of the photograph 14 in an abutted relationship against the guide lines 13 insures the exact centering of the photograph 14.

The standard sized photographs 14 to be utilized with the mount 10 of the present invention are enlargements of film negatives. The normal conventional sized print is three and one half by five inches. The mount 10 of the present invention is adaptable to conventional size, as well as enlargements, which are of standard size.

The mounting adhesive 12 currently utilized in the mount 10 is a commercially available produce manufactured by the Minnesota Mining and Manufacturing Company of Minneapolis, Minn. The product is called "PMA" for positionable mounting adhesive. The mounting adhesive 12 provides for double-stick qualities, i.e., adhesion between two separate layers after removal of the release sheets 17 and 18. The mounting adhesive 12 allows the positioning of the standard photograph 14 and, if necessary, the repositioning of the photograph 14 to obtain proper alignment. Once significant pressure is utilized to direct the back surface of the standard photograph 14 into contact with the mounting adhesive 12, the adhesion becomes permanent, and actually, as a result of curing, becomes stronger with age. The mounting adhesive 12 covers one entire surface of the backboard 11.

The release sheets 17 and 18 are concentric with respect to each other. The center section release sheet 17 is of rectangular configuration substantially identical in dimension to the standard sized photograph 14 which will ultimately contact the mounting adhesive 12 between the center section release sheet 17 and the backboard 11. The framing release sheet 18 is substantially of identical dimension and area as the border 21 around the standard sized photograph 14 to be mounted to the mount 10 (FIG. 5). Both the release sheets 17 and 18 are made of a waxy surfaced paper that will not permanently adhere to the mounting adhesive 12 and the backboard 11.

Figure 1:
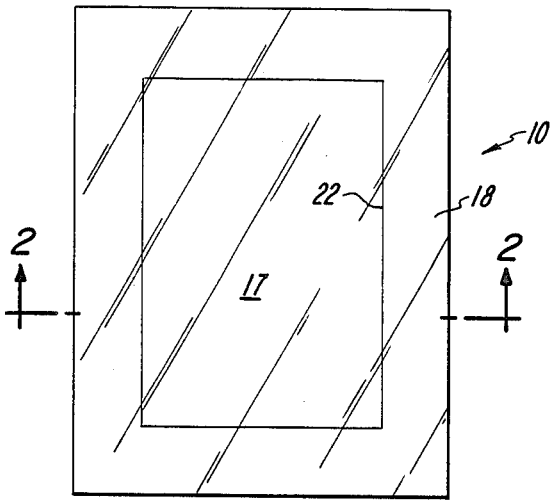
FIG. 1 is a front elevational view of a picture mount of the invention.

A score line 22 (FIGS. 1 and 2) separates the center section release sheet 17 from the framing release sheet 18. Referring to the score line 22, it will be seen that the framing release sheet 18 is outwardly adjacent to the center section release sheet 17. The score line 22 is coincident with the guide lines 13 of the backboard 11.

The mat 15 is of rectangular configuration having top and bottom edges 25 corresponding to top and bottom edges 19 of the backboard 11, and side edges 26 corresponding to the side edges 20 of the backboard 11. The mat thus can be placed over the backboard 11 in a registered relationship thereto. A mat opening 23 is formed centrally of the mat 15. Both the edges of the mat 25 and 26 and the mat opening 23 are precut so as to conform to the backboard 11 and the standard sized photograph 14 respectively.

Figure 7:
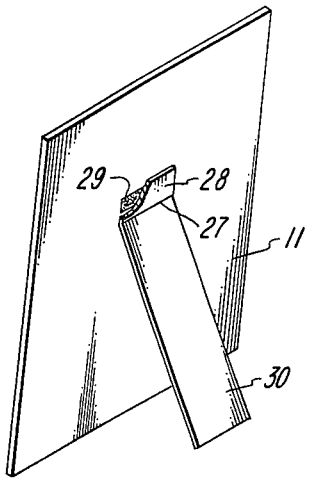
FIG. 7 is a rear perspective view of a mounted and matted picture with part of an easel back broken away for clarity.

The easel back 30 (FIG. 7) is an elongated cardboard piece having a fold line 27 nearer one end 28 thereof. The end 28 has a layer of mounting adhesive 29 incorporated thereon. Removal of a strip covering the adhesive (not shown) allows the easel back 30 to be secured to the backboard 11.

Figure 3:
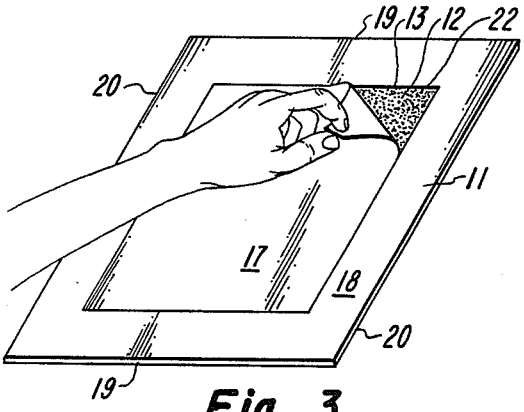
FIG. 3 is a perspective view of the first step of mounting a picture using the invention shown in FIG. 1.

The mount 10, mat 15 and easel back 30 are prepackaged in the polyethylene film 16 that is heat shrunk around the mount 10. The package therefore includes the backboard 11, mounting adhesive 12 and release sheets 17 and 18 adhered thereto, together with the separate mat 15 and easel back 30. The method of using the mount 10 includes the initial steps of acquiring a standard sized photograph 14 which is to be mounted and removing the plastic film packaging 16 from the mount 10. The center section release sheet 17 is peeled away from the mounting adhesive 12 along score line 22 (FIG. 3) exposing the mounting adhesive 12 to the atmosphere. Utilizing the guide lines 13, the photograph 14 is manually positioned to essentially center it by abutting the photograph against the slightly larger guide lines 13 provided for the standard sized photograph 14 (FIG. 4). Utilizing the properties of the "PMA" mounting adhesive 12, the standard sized photograph 14 is repositioned as necessary. Once the proper centering position is achieved, the user can use the center section release sheet 17 to press the standard sized photograph 14 into permanent position (not shown), avoiding finger prints.

The user then removes the framing release sheet 18, exposing the mounting adhesive 12 in the area of the border 21 (FIG. 5). The mat 15 is then registered relative to the backboard 11 and pressed into contact with the mounting adhesive 12 on the border 21 (FIG. 6). The standard sized photograph 14 is now mounted and ready for framing or displaying by attachment of the easel back 30 in the attractive manner in which it is mounted.

Although the present invention has been described with a certain degree of particularity, it is understood that the present disclosure has been made by way of example and that changes in the detailed structure may be made without departing from the spirit thereof.

What is claimed is:

1. A laminated photographic mount for a standard size photograph, including a rectangularly-shaped backboard having outer edges of pre-established length and width, one surface of said backboard having a layer of mounting adhesive pre-applied thereto, to which backboard surface a back surface of said photograph and a photographic mat are to be mounted, and upon which mounting adhesive a pair of concentrically configured release sheets are adhered, said mounting adhesive allowing for selective positioning and repositioning of the back surface of said photograph and said mat on said backboard until substantial pressure is applied thereto, the first release sheet is generally centered with respect to the backboard and rectangular dimension is substantially the same as the standard size photograph, the second release sheet frames and surrounds the first release sheet in an adjacent relationship thereto, said photographic mat precut to have an interior opening of dimension substantially the same as aligned with the standard size photgraph, as mounted on said backboard, an outer edge of substantially the same length and width dimensions as the outer edge of said backboard upon mounting said mat on said backboard, and an easel back having said adhesive means thereon for adhesively securing to the surface of said backboard opposite the mounting adhesive surface.

2. A laminated photographic mount for a standard size photograph, including a rectangularly-shaped backboard having outer edges of pre-established length and width, one surface of said backboard having a layer of mounting adhesive pre-applied thereto, to which backboard surface a back surface of said photograph and a photographic mat are to be mounted, and upon which mounting adhesive a pair of concentrically configured release sheets are adhered, said mounting adhesive allowing for selective positioning and repositioning of the back surface of said photograph and said mat on said backboard until substantial pressure is applied thereto, the first release sheet is generally centered with respect to the backboard and rectangular dimension is substantially the same as the standard size photograph, the second release sheet frames and surrounds the first release sheet in an adjacent relationship thereto, said photographic mat precut to have an interior opening of dimension substantially the same as aligned with the standard size photgraph, as mounted on said backboard, an outer edge of substantially the same length and width dimensions as the outer edge of said backboard upon mounting said mat on said backboard.

* * * * *